US005280917A

United States Patent [19]

Lopez Ortiz

[11] Patent Number: 5,280,917

[45] Date of Patent: Jan. 25, 1994

[54] CATCH AND PROJECT HELMET APPARATUS

[76] Inventor: Victor M. Lopez Ortiz, Bo. Camaseyes, HC-01 Box 691, Aguadilla, P.R. 00603

[21] Appl. No.: 48,318

[22] Filed: Apr. 19, 1993

[51] Int. Cl.[5] ..... A63B 65/12

[52] U.S. Cl. ..... 273/318; 273/DIG. 17; 446/27

[58] Field of Search ..... 273/181 D, 190 R, 199 A, 273/313, 318, 398, DIG. 17; 446/26, 27

[56] References Cited

U.S. PATENT DOCUMENTS

| | | | |
|---|---|---|---|
| 2,760,304 | 8/1956 | Chirco et al. | 273/DIG. 17 |
| 3,182,422 | 5/1965 | Ryan | 273/DIG. 17 |
| 3,341,201 | 9/1967 | Ryan | 273/DIG. 17 |
| 3,545,760 | 12/1970 | Wilson | 446/27 X |
| 3,628,794 | 12/1971 | Conture | 273/DIG. 17 |
| 3,775,899 | 12/1973 | Wolf | 446/27 X |
| 4,932,670 | 6/1990 | Brown | 273/318 |

FOREIGN PATENT DOCUMENTS

| | | | |
|---|---|---|---|
| 9109268 | 6/1991 | World Int. Prop. O. | 273/DIG. 17 |

*Primary Examiner*—William Stoll
*Attorney, Agent, or Firm*—Leon Gilden

[57] ABSTRACT

A helmet member configured as a truncated conical rigid configuration includes an entrance end to receive a ball member therewithin, wherein a rear wall portion of the basket includes a guide tube slidably and reciprocatably mounting a projectile tube, wherein the projectile tube is arranged to receive the ball member therein and electively expel the ball from the basket member subsequent to its being captured therewithin. The basket member is mounted to an associated helmet, wherein the catching and projecting of the ball member is effected solely by use of the basket in practice.

7 Claims, 4 Drawing Sheets

CATCH AND PROJECT HELMET APPARATUS

BACKGROUND OF THE INVENTION

1. Field of the Invention

The field of invention relates to catch and release structure, and more particularly pertains to a new and improved catch and project helmet apparatus arranged to receive and subsequently expel a ball member from the helmet basket structure.

2. Description of the Prior Art

Various catch and throw toys are availed in the prior art such as exemplified in U.S. Pat. Nos. 3,953,030; 4,017,076; and 4,718,677. U.S. Pat. No. 3,628,794 sets forth a helmet member having an inverted semi-spherical container to receive a ball member therewithin.

The instant invention provides for an advancement over the prior art in the reception and projection of a ball member relative to the associated basket structure mounted to an associated helmet and in this respect, the present invention substantially fulfills this need.

SUMMARY OF THE INVENTION

In view of the foregoing disadvantages inherent in the known types of catch and release apparatus now present in the prior art, the present invention provides a catch and project helmet apparatus wherein the same is arranged to receive and subsequently project a ball member relative to an associated basket mounted to a helmet of the invention. As such, the general purpose of the present invention, which will be described subsequently in greater detail, is to provide a new and improved catch and project helmet apparatus which has all the advantages of the prior art helmet apparatus and none of the disadvantages.

To attain this, the present invention provides a helmet member configured as a truncated conical rigid configuration, including an entrance end to receive a ball member therewithin, wherein a rear wall portion of the basket includes a guide tube slidably and reciprocatably mounting a projectile tube, wherein the projectile tube is arranged to receive the ball member therein and electively expel the ball from the basket member subsequent to its being captured therewithin. The basket member is mounted to an associated helmet, wherein the catching and projecting of the ball member is effected solely by use of the basket in practice.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved catch and project helmet apparatus which has all the advantages of the prior art helmet apparatus and none of the disadvantages.

It is another object of the present invention to provide a new and improved catch and project helmet apparatus which may be easily and efficiently manufactured and marketed.

It is a further object of the present invention to provide a new and improved catch and project helmet apparatus which is of a durable and reliable construction.

An even further object of the present invention is to provide a new and improved catch and project helmet apparatus which is susceptible of a low cost of manufacture with regard to both materials and labor, and which accordingly is then susceptible of low prices of sale to the consuming public, thereby making such catch and project helmet apparatus economically available to the buying public.

Still yet another object of the present invention is to provide a new and improved catch and project helmet apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
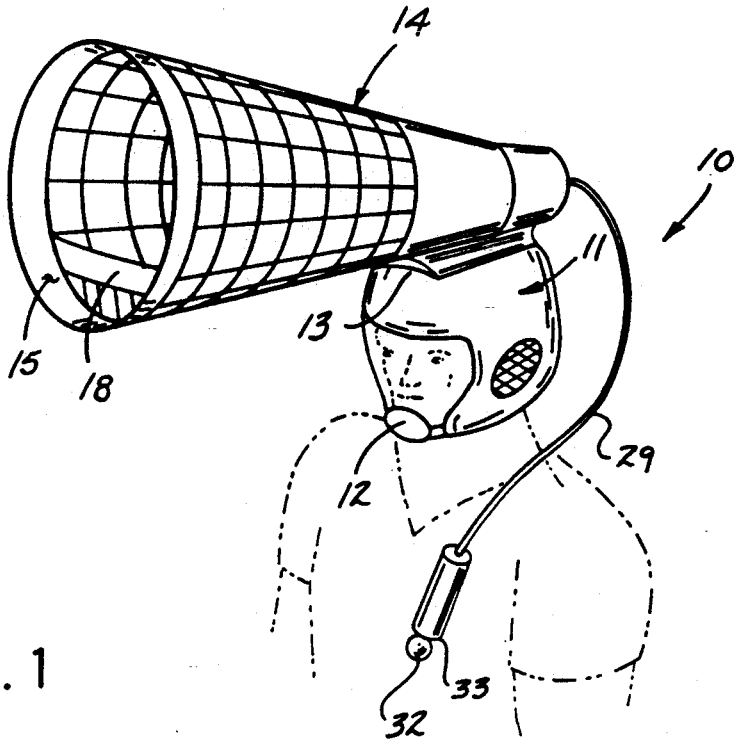
FIG. 1 is an isometric illustration of the invention.

With reference now to the drawings, and in particular to FIGS. 1 to 8 thereof, a new and improved catch and project helmet apparatus embodying the principles and concepts of the present invention and generally designated by the reference numerals 10 and 10*a* will be described.

More specifically, the catch and project helmet apparatus 10 of the instant invention essentially comprises a rigid helmet 11 having a chin strap 12 for securement of the helmet relative to an individual, as indicated in FIG. 1. The helmet 11 includes a helmet top wall 13 spaced in an opposed relationship relative to the chin strap 12 to integrally mount a basket mount 16 thereon. A truncated conical basket 14 coaxially aligned and secured to a support tube housing 21 that in turn is secured to the basket mount 16 is provided in an integral relationship relative to the basket mount 16, as the truncated conical basket 14 extends forwardly of and beyond the helmet, to include a basket entrance opening 15. The opening 15 includes a lowermost end 15*a* extending to the visor opening 11*a* of the helmet. The basket 14 further includes a basket rearward end 17 coaxially aligned and spaced from the forward entrance opening 15 at an interface between the basket 14 and the support tube housing 21. A cylindrical guide tube 19 is provided coaxially aligned relative to the axis 29 of the basket and the housing 14 and 21 respectively. A support tube housing 21 includes a rear wall 22 orthogonally oriented relative to the axis 29 and spaced from the basket rearward end 17. A plurality of parallel coextensive slots 23 spaced from and parallel the axis 29 an equal distance therefrom are directed through the guide tube 19 slidably mounting a guide rod 24 therethrough, as the guide rod 24 is orthogonally oriented relative to the axis 29. Each end of the guide rod 24 projects from the guide tube 19 and is spaced from a securement pin 26 that is longitudinally aligned with one of said slots 23, wherein an elastomeric band 25 is captured about a free end of the guide rod 24 and an adjacent securement pin 26 to bias the guide rod 24 towards the basket rearward end 17. A projectile tube 27 is slidably mounted within the guide tube 19, having the guide rod 24 fixedly secured to a rearward end of the projectile tube, with a forward end of the projectile tube including a tube bumper 28 such that projection of the projectile tube 27 towards the guide tube forwardmost end 19*a* from the guide tube rearwardmost end 19*b* projects a ball "B" (see FIG. 2) from within the basket 14. Mounted to the rear wall 22 is a flexible guide conduit 30, having its first end secured to the rear wall and its second mounted to a handle tube 33, wherein within the guide conduit 30 is a control cable 31 having its control first end secured to the guide rod 24 and its second end secured to a handle 32, whereupon displacement of the handle 32 relative to the handle tube 33 retracts the projectile tube 27 within the guide tube 19, whereupon release of the handle 32 permits release and projection of the projectile tube 27 towards the basket rearward end 17 to direct and hurtle the ball 17 therefrom. The handle tube 33 is provided with a handle tube covering 34 of sponge-like material to enhance manual grasping thereof, with a support strap 35 mounted to the handle tube, that includes a button slot 36 for permitting ease of mounting of the handle tube to an individual's garment button.

Figure 2:
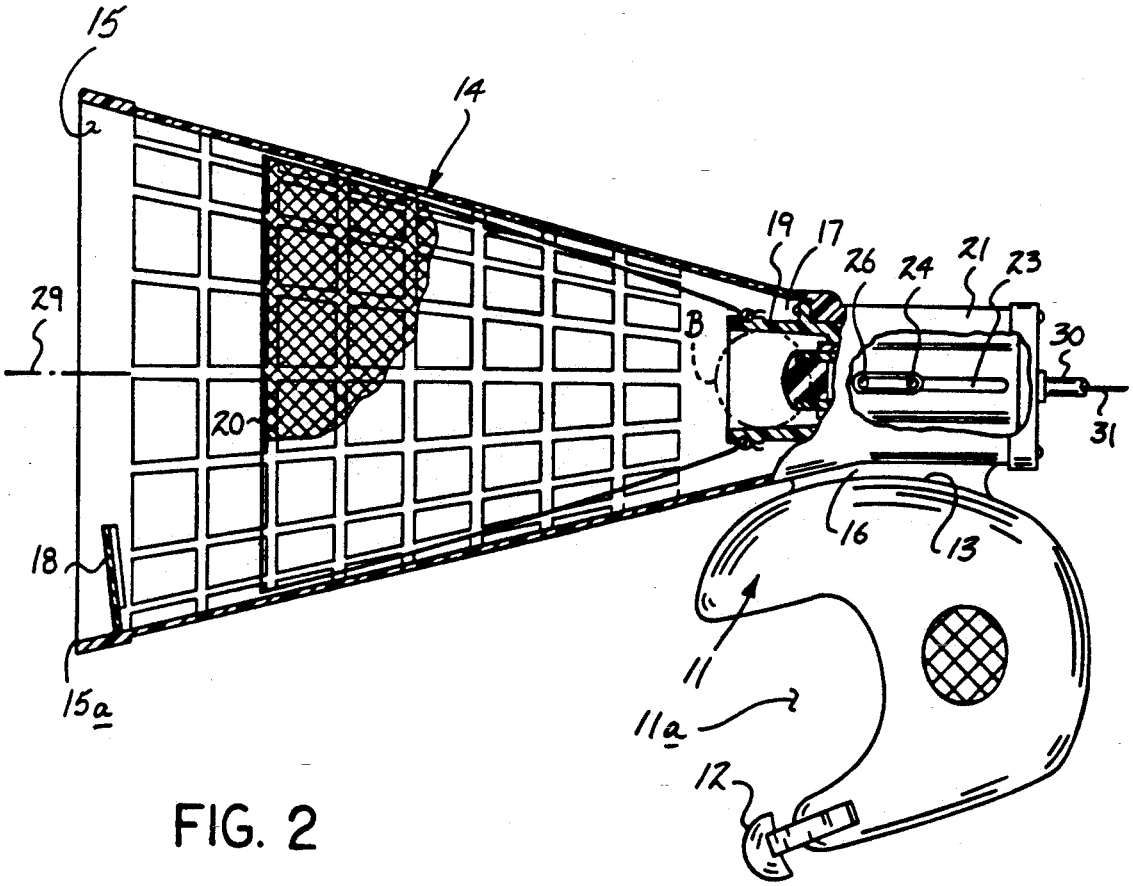
FIG. 2 is an orthographic view, partially in cross-section, of the invention.
Figure 3:
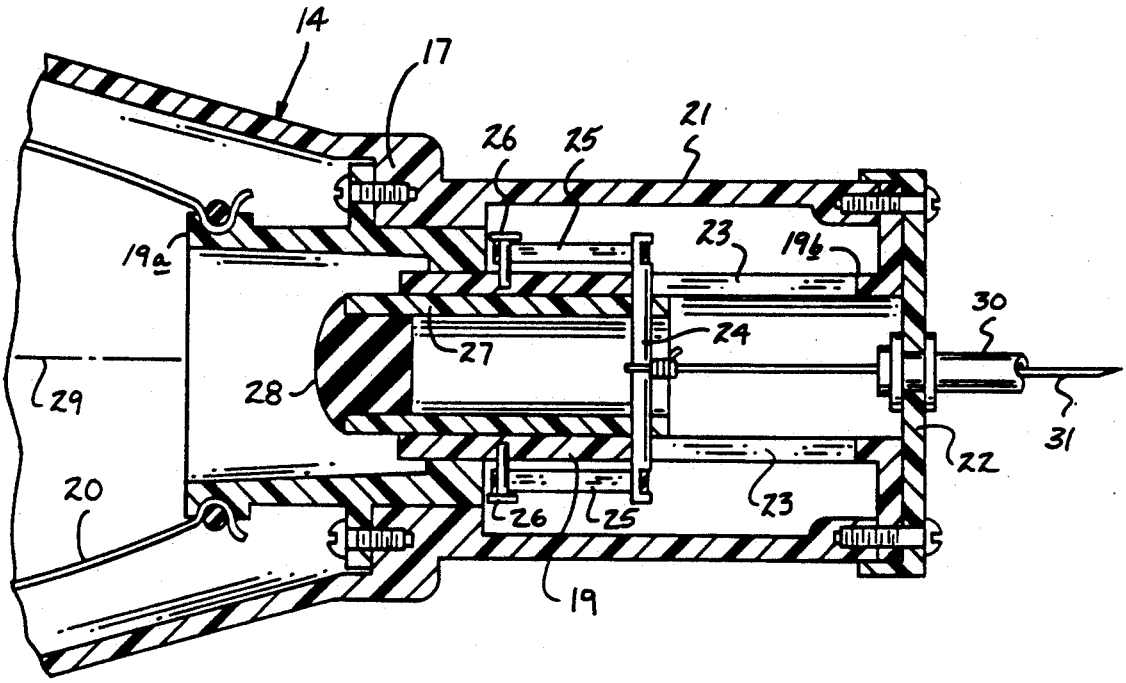
FIG. 3 is an enlarged orthographic cross-sectional illustration of the support tube housing mounting the basket member thereto in a coaxially aligned relationship.
Figure 4:
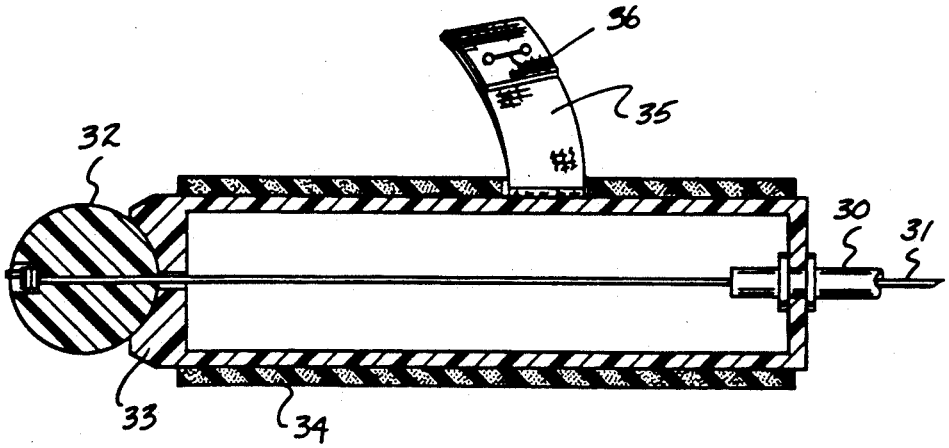
FIG. 4 is an orthographic cross-sectional illustration of the handle tube arranged to released the projectile tube within the support tube housing.
Figure 5:
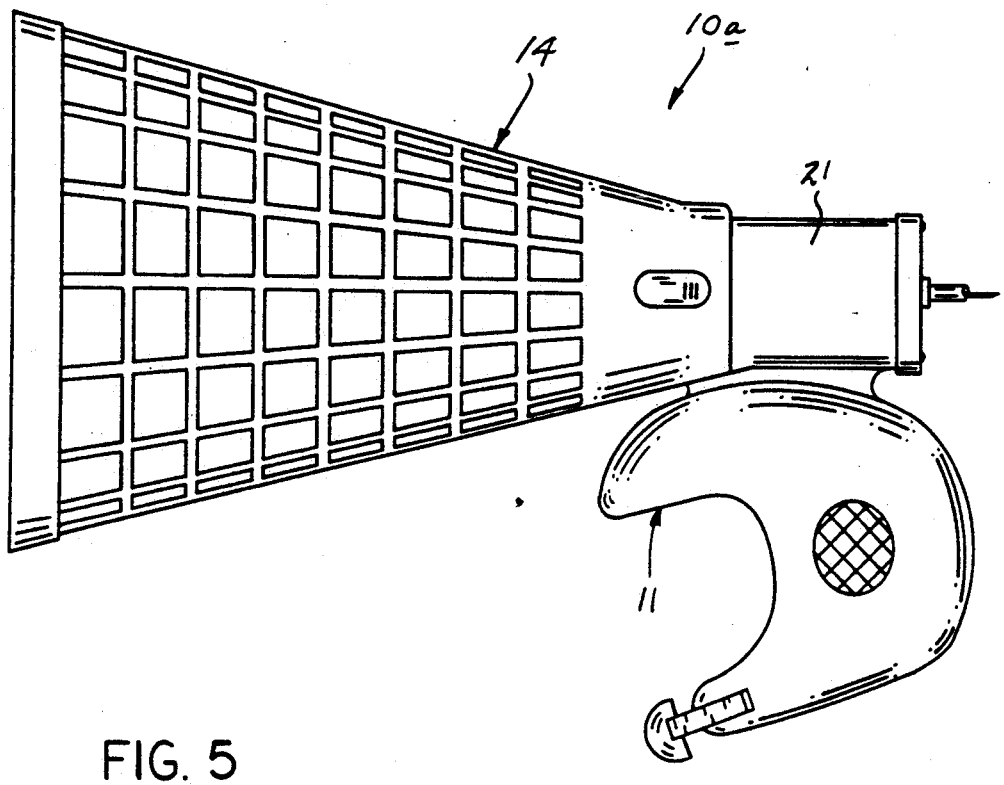
FIG. 5 is an orthographic side view of a modified aspect of the invention.
Figure 6:
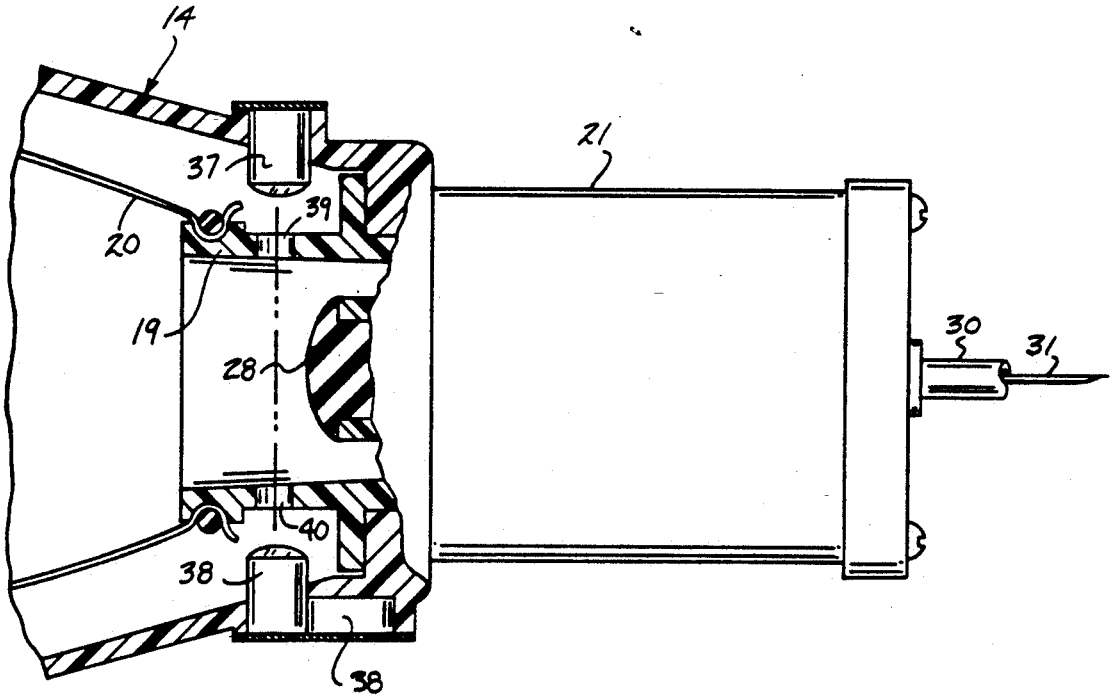
FIG. 6 is an enlarged orthographic view, partially in section, of the modified invention as indicated in FIG. 5.

The apparatus 10*a*, as indicated in FIGS. 5 and 6, additionally includes first and second photocell sensors 37 and 38 that are coaxially aligned and positioned adjacent first and second apertures 39 and 40 through the guide tube 19 in adjacency to the guide tube forward end 19*a*. When the ball "B" is positioned within the guide tube in a desired orientation relative to the projectile tube 27, an audible signal generator 38*a* in cooperation with the first second photocell sensors 37 and 38 generates an audible signal indicating that the ball "B", such as indicated in FIG. 2, is appropriately positioned for projection by use of the projectile tube 27, as discussed above.

Figure 7:
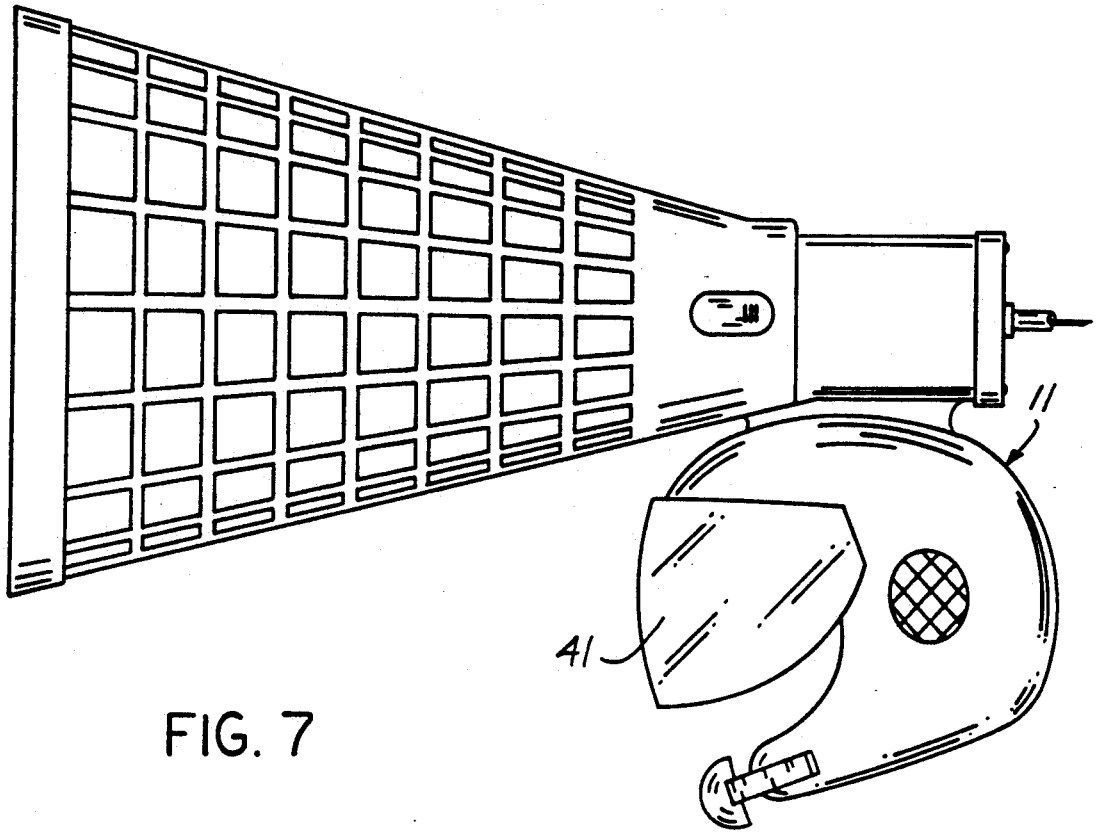
FIG. 7 is an orthographic view of the invention employing a pivotal shade member mounted to the helmet structure.
Figure 8:
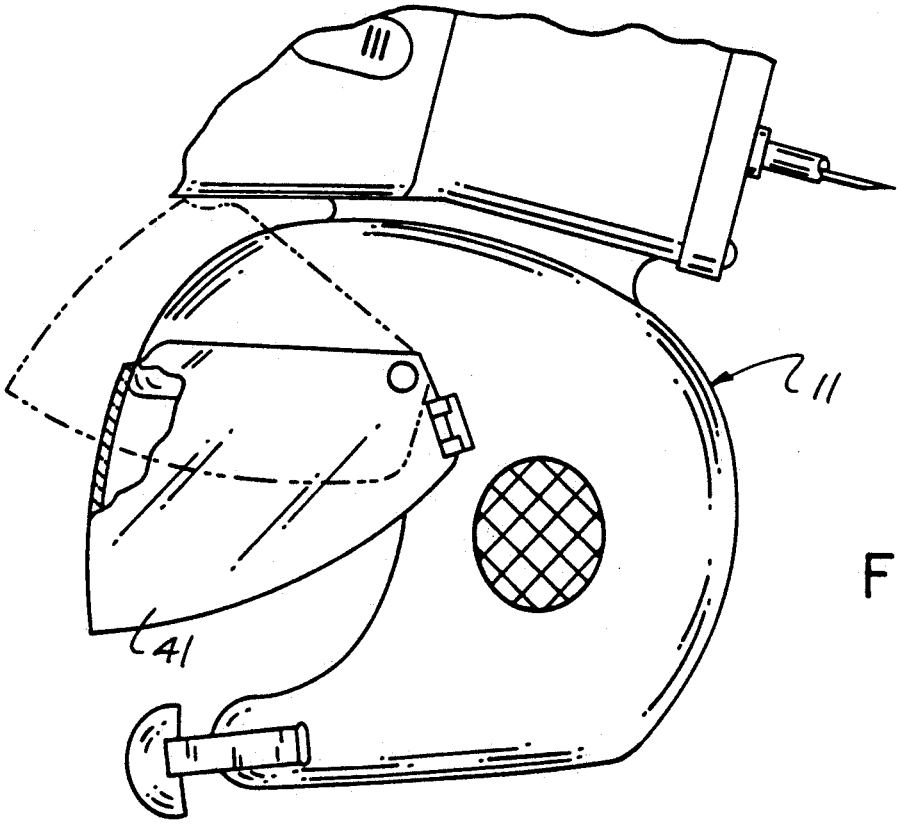
FIG. 8 is an enlarged orthographic view indicating the shade member arranged in a displaced orientation relative to the helmet.

The FIGS. 7 and 8 further include the use of a translucent helmet visor 41 pivotally mounted to the helmet about the visor opening, wherein the visor 41 is typically of a coloration to promote a degree of difficulty in visually ascertaining the orientation of an incoming ball "B" relative to the basket member entrance opening 15.

As to the manner to usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A catch and project helmet apparatus, comprising, a rigid helmet, the helmet having a helmet opening, with a chin strap positioned in adjacency to the helmet opening for securement of the helmet to an individual, wherein the helmet includes a helmet top wall, and the helmet top wall having a basket mount fixedly mounted to the helmet top wall, and an elongate truncated conical basket, the basket including a basket first end spaced from a basket second end, the basket second end having a support tube housing fixedly mounted to the basket second end in a coaxially aligned relationship along a predetermined axis, with the basket first end having an entrance opening, with the entrance opening extending from said axis to the facial opening of said helmet to permit reception of a ball member within said basket, and the support tube housing includes a cylindrical guide tube coaxially aligned along the axis, with the support tube housing having a support tube housing rear wall spaced from the basket second end, and the guide tube extending from the rear wall through the basket second end in a coaxially aligned relationship along the axis, the guide tube having a projectile tube coaxially aligned within the guide tube and slidably mounted within the guide tube, with the projectile tube having a projectile tube bumper member mounted at a projectile tube first end arranged for projection through the guide tube for impact with a ball member positioned within the guide tube in adjacency to the basket second end, and drive means arranged to displace the projectile tube from a first position in adjacency to the rear wall to a second position directed to the basket second end.

2. An apparatus as set forth in claim 1 wherein the drive means includes the guide tube including at least one slot parallel and spaced from the axis within the guide tube, with the slot having a guide rod orthogonally oriented through the axis fixedly mounted relative to the projectile tube second end and received through the slot, with the guide rod having a pin member fixedly mounted to the guide tube spaced from the slot, and an elastomeric band extending from the pin to the guide rod, and a control cable direction through the rear wall, with the control cable having control cable first end mounted to the guide rod within the guide tube, and the control cable including a cable second end positioned exteriorly of the support tube housing to permit tensioning of the control cable and displacement of the projectile tube from the second position to the first position.

3. An apparatus as set forth in claim 2 including a guide conduit fixedly mounted to the rear wall and extending from the rear wall, with a handle tube secured to the guide tube spaced from the rear wall, with the control cable directed through the handle tube terminating in a handle, with the handle mounted to the cable second end permitting ease of displacement of the handle relative to the handle tube.

4. An apparatus as set forth in claim 3 wherein the handle tube includes a support strap, with the support strap including a button slot directed through the support strap permitting securement of the button strap to an individual garment.

5. An apparatus as set forth in claim 4 including a capture web, the capture web positioned in adjacency to the entrance opening substantially orthogonally oriented relative to the axis.

6. An apparatus as set forth in claim 5 further including a truncated control directional web, having a web first end positioned in adjacency relative to the capture web, and the directional web having a directional web second end mounted to the guide tube first end to direct a ball into the guide tube when received within the basket.

7. An apparatus as set forth in claim 6 wherein the guide tube first end includes a first aperture and a second aperture, with the first aperture and second aperture coaxially aligned relative to one another and orthogonally oriented relative to said axis, with a first photocell sensor positioned in adjacency to the first aperture and a second photocell sensor positioned in adjacency to the second aperture for sensing of said ball within said guide tube.

* * * * *